United States Patent [19]

Giulie

[11] 4,184,782

[45] Jan. 22, 1980

[54] BINDING DEVICE

[75] Inventor: Joe D. Giulie, Los Altos, Calif.

[73] Assignee: Minnesota Mining and Manufacturing Company, St. Paul, Minn.

[21] Appl. No.: 755,247

[22] Filed: Dec. 29, 1976

[51] Int. Cl.[2] ..... A46B 15/00

[52] U.S. Cl. ..... 402/15; 24/16 PB; 24/129 R

[58] Field of Search ..... 402/13, 14, 15, 17, 402/8, 16; 281/25 R; 24/16 PB, 28, 16 R, 117 R, 130, 134, 129 R, 129 W

[56] References Cited

U.S. PATENT DOCUMENTS

| | | | |
|---|---|---|---|
| 322,501 | 7/1885 | Taylor | 24/129 R |
| 916,671 | 3/1909 | Chandler | 24/129 R |
| 1,660,829 | 2/1928 | Burd | 24/129 R |
| 2,166,847 | 7/1939 | Miller et al. | 24/130 X |
| 3,285,250 | 11/1966 | Ivory et al. | 402/16 |
| 3,418,733 | 12/1968 | Tyrrell et al. | 24/117 R |

FOREIGN PATENT DOCUMENTS

| | | | |
|---|---|---|---|
| 1196243 | 6/1970 | United Kingdom | 15/ |
| 1400460 | 7/1975 | United Kingdom | 402/15 |

*Primary Examiner*—Stephen C. Pellegrino

*Attorney, Agent, or Firm*—Cruzan Alexander; Donald M. Sell; William L. Huebsch

[57] ABSTRACT

A device for binding a stack of sheets including a binding strip (support member) to which the sheets are secured by an elongated, flexible, radially deformable filament. At least one end of the filament is attached to the binding strip by a serpentine locking channel recessed in the binding strip. The locking channel is adapted to engage and deform a length of the filament when that length is inserted into the serpentine channel. In a preferred embodiment, such engagement and deformation occur at alternating areas on opposite sides of the filament and prevent longitudinal displacement of the filament; and thus the device forms a tight binding.

15 Claims, 13 Drawing Figures

BINDING DEVICE

BACKGROUND OF THE INVENTION (1) Field of the Invention

This invention relates to a device for binding a stack of sheets; and in one aspect to a device for binding a stack of paper sheets.

(2) Description of the Prior Art

The art is replete with inexpensive devices for binding stacks of sheets comprising a binding strip (support member) and a plurality of filaments adapted to engage and bind the sheets to the binding strip. Generally, however, such devices are not as efficient or convenient as may be desired.

For example, U.S. Pat. No. 3,874,705 describes a binding device having polymeric studs or monofilaments adapted to pass through apertures in a stack of paper sheets and mate with countersunk holes in a binding strip. The ends of the plastic studs or monofilaments are formed into heads within the countersink and lock the stud and binding strip together. Such a binding device requires rather complex installation equipment to cut the studs off at an appropriate length and then form the heads within the countersink by the application of heat and/or pressure.

U.S. Pat. Nos. 3,026,876; 3,176,363; and 3,217,372 describe the use of flexible, resilient, polymeric monofilaments with binding strips in loose-leaf notebooks. The filaments are threaded through apertures in paper sheets to be secured in the notebook, are bent at right angles adjacent the top sheet and secured in that position under hooks or tabs that project from the binding strip. The ends of these monofilaments are not secured against longitudinal movement, however, and thus could tend to loosen with usage of the bound document. Also the projecting hooks or tabs may not provide as smooth a profile for the binding device as may be desired for many applications.

U.S. Pat. No. 3,654,668, and Australian Pat. No. 1,196,243 describe binding devices using elongated, elastic, longitudinally extensible elements that mate with recessed locking channels in a binding strip to secure objects thereto. The binding strip of U.S. Pat. No. 3,654,668 has a channel whose diameter is less than the diameter of the unstretched element. The element is stretched to decrease its diameter during insertion into the channel, after which the element is allowed to retract toward its original dimension so that it provides an interference fit with the channel. U.S. Pat. No. 1,196,243 describes a loose-leaf paper binder using an extensible tubular element that is mated with a recessed locking channel having directly opposed teeth, which teeth exert a clamping force on the tubular element when it is placed in the channel. Binding devices using elastic, longitudinally extensible elements, however, cannot form a tight, firm binding such as is desirable for many documents.

SUMMARY OF THE INVENTION

The present invention provides a simple, inexpensive device for temporarily or permanently binding a stack of sheets. The device can be easily attached without complex machinery and after attachment provides a tight, strong binding which will not loosen significantly upon use of the bound document. The binding device when installed can have a low profile and no protuberances so that a stack of sheets bound by the binding device can be used without the additional expense of a cover. Also the device affords sufficient binding flexibility that a thick stack of sheets can be bound.

According to the present invention there is provided a binding device that includes at least one flexible, radially deformable filament that is generally nonextensible in a longitudinal direction under normal binding forces, that does not have a significant cross-sectional area reduction under normal binding forces and that is adapted to pass around or through a stack of sheets. The device also includes at least one support member adapted to be positioned adjacent the stack of sheets to be bound and means for attaching the filament and the support member together to bind the stack of sheets to the device. The attaching means comprises the support member having wall means that define a serpentine locking channel that is capable of engaging and deforming the filament when inserted therein.

The filament of the present invention is generally nonextensible under normal binding tension (e.g. nonelastomeric and hence a material having a reversible elongation below 100%, and preferably below 25%) so that it provides a tight binding; however, nonextensible as used herein does not mean that the filament will not stretch slightly under large longitudinal tension. For example, a nylon monofilament of the preferred embodiment having a 60 pound (267 newton) test strength and a 0.032 inch (0.81 mm) diameter will longitudinally and elastically stretch about 14% under 40 pounds (178 newton) of tension (i.e., 50,000 P.S.I. or $3.45 \times 10^8$ newton/m$^2$) which is deemed acceptable.

The filament of the present invention does not have a significant cross-sectional area reduction under normal binding tension. Thus, normal binding tension on the filament will not interfere with the locking action between the wall means and the radial deformations created in the filament during insertion.

The filament of the present invention is radially deformable; by radially deformable is meant the ability to be squeezed or distended when subjected to a force acting radially to the filament.

The serpentine locking channel of the present invention twists or winds its way by turning in first one direction and then another direction in either a regular or irregular manner. For example, a centerline between the opposed walls will form a twisting or winding path. This serpentine property of the channel significantly contributes toward providing a high strength binding.

The means for attaching the filament to the support member may include means for guiding the filament into one end of the serpentine locking channel. Such means for guiding directs tensional forces applied to the filament longitudinally along the length of the filament in the channel to engage the filament deformations with the wall means, rather than to lift the filament from the channel.

In a general preferred form, the wall means forming the serpentine locking channel comprises opposed walls recessed from a first surface of the support member, each of which opposed walls is shaped to provide a plurality of teeth having tips projecting toward the other of the opposed walls.

The filament is preferably a polymeric (e.g., nylon) monofilament having a solid cross-section. However, it is believed that a very tightly woven plural strand filament, or a polymeric coated wire could be used. The filament has a uniform cross-section throughout its length and preferably has a circular cross section of a uniform diameter throughout its length. The surface of the filament may or may not be texturized.

A preferred material for the support member is Delrin® (a linear polyoxymethylene-type acetal resin) which is stiff, flexible and easily molded; however, other relatively stiff polymers or metals could also be used. A preferred shape for the support member is a long, narrow strip; however, the support member could be formed to be an entire cover member for a stack of sheets for example.

One embodiment of the binding device is adapted for binding together a stack of paper sheets having apertures along one edge portion. That embodiment includes a pair of long, narrow binding strips (support members) adapted to extend along and on opposite side surfaces of the stack of paper sheets adjacent the apertures. Serpentine locking channels are recessed from a surface of each binding strip that is opposite to the surface that is adjacent the paper surface. Openings in the binding strips are registered with the apertures in the paper and each of the openings communicates with one end of one of the locking channels. A plurality of filaments bind the paper sheets between the strips. Each filament is threaded through one of the apertures in the paper and the registered opening in each binding strip with a length of the filament adjacent each of its ends being inserted into the corresponding recessed locking channel in each strip to attach the binding device to the paper sheets. Other alternate embodiments of the device adapted for binding such apertured paper sheets may use only one or two filaments each of which is laced through a plurality of apertures in the paper and registered openings in the strips. In these configurations the filament passing along the strip between adjacent openings may be received in grooves which need not be locking channels so long as at least one locking channel is provided for receiving a length of at least one end of the filament.

Other embodiments of the binding device are adapted for binding one or more folded stacks of paper sheets to the binding strip (support member) as is useful for binding a magazine within a cover or binding a plurality of magazines together. In these embodiments the binding strip is adapted to extend along the outer surface of the stack or stacks of paper adjacent their folds. One filament is placed against the inner surface of one sheet of each of the stacks adjacent its fold and the ends of the filament are attached to the ends of the binding strip by means including a locking channel of the type previously described.

As can be seen from these illustrative embodiments a binding device of the present invention is easily adaptable to stacks of sheets having various sizes and shapes because both the filament and the binding strip (support member) can be easily adapted to be various sizes and shapes. In the embodiments where the filament and the support member are made as separate parts, the binding device can be adapted to stacks of sheets of various thicknesses by simply cutting the filament to a required length.

The binding device according to the present invention is easy to install. Its parts can be mated by small amounts of pressure using a simple hand tool, and no gluing, stitching, stapling, heat or large amounts of pressure are required. Because the binding elements are simple to mate, the opportunity for improper installation is minimized.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENTS

Figure 1:
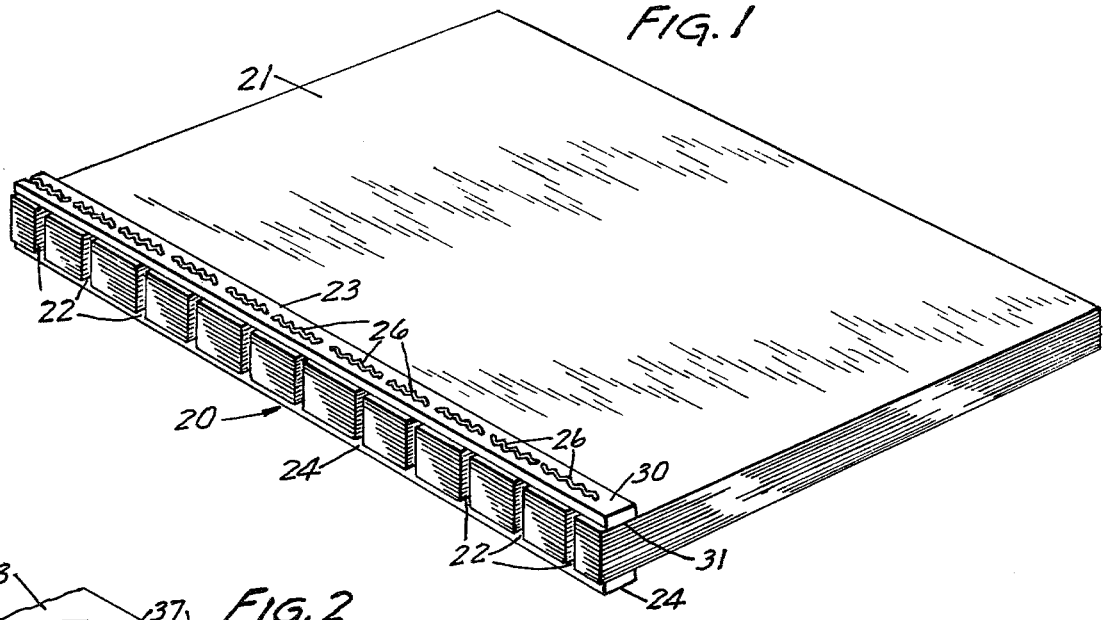
FIG. 1 is a perspective view of a stack of paper sheets bound by a first embodiment of a binding device according to the present invention.
Figure 2:
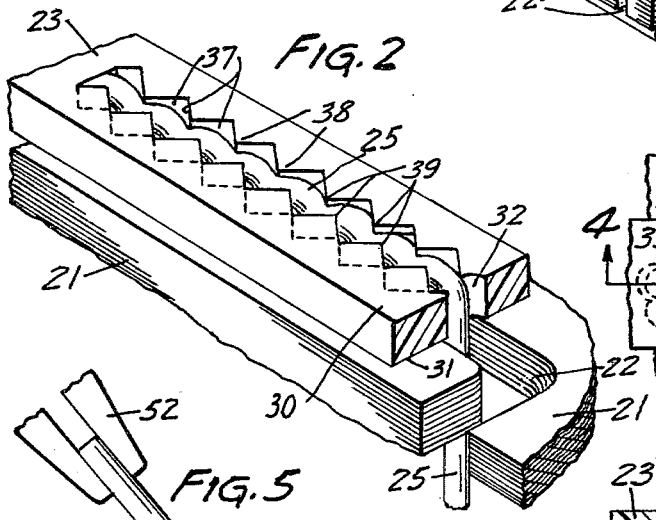
FIG. 2 is an enlarged fragmentary perspective view of the binding device and the stack of paper sheets of FIG. 1.
Figure 3:
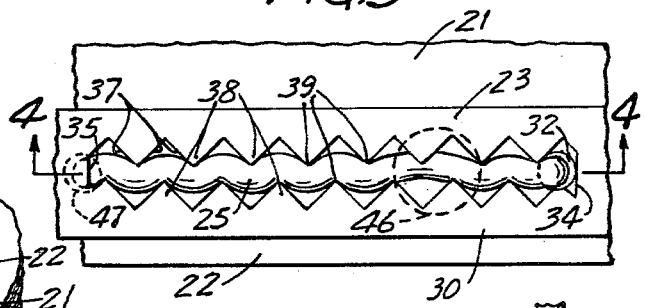
FIG. 3 is an enlarged fragmentary plan view of the binding device and the stack of paper sheets of FIG. 1 generally corresponding to the fragment shown in FIG. 2.
Figure 5:
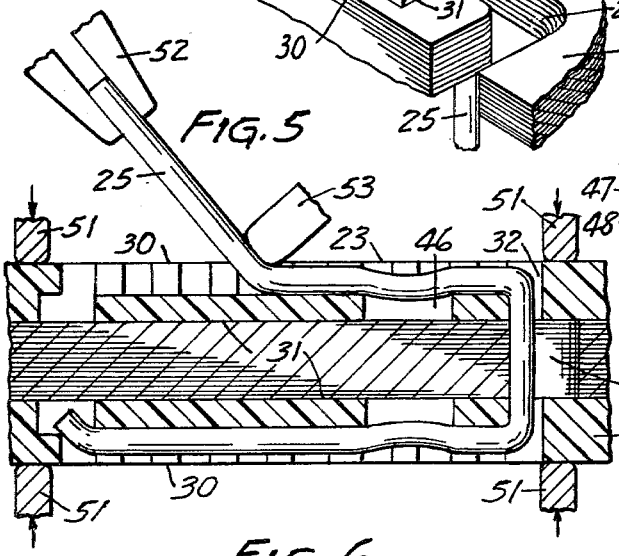
FIGS. 4, 5 and 6 are sectional views taken approximately along the line 4—4 of FIG. 3 which sequentially illustrate the insertion of a filament into a locking channel.

Referring now to FIGS. 1 through 6, there is illustrated a first embodiment of a binding device according to the present invention, generally designated by the numeral 20. The binding device 20 is shown binding together a stack of paper sheets 21 having a plurality of spaced apertures or L-shaped slots 22 along one edge portion. The binding device 20 comprises first and second support members such as strips 23 and 24 attached together by a plurality of filaments 25. Each filament 25 passes through a different one of the apertures 22 in the paper and has a length adjacent each of its ends attached to one of the strips 23 and 24 by releasable attaching means comprising serpentine locking channels 26 recessed in the strips 23 and 24.

Each of the filaments 25 is an elongated, flexible, bendably resilient, radially deformable, polymeric monofilament that is generally nonextensible in a longitudinal direction under normal binding forces, that does not have a significant cross-sectional area reduction under normal binding forces and that has a solid circular cross section of given uniform diameter throughout its length. Each filament 25 is sufficiently long to pass through one of the apertures 22 in the paper 21 and have a length adjacent each of its ends inserted in one of the serpentine locking channels 26.

The strips 23 and 24 are long and narrow, have a rectangular cross section and have opposite first and second surfaces 30 and 31. They are adapted to extend along and on opposite sides of the stack of paper sheets 21 with their second surfaces 31 positioned adjacent the apertures 22. Each of the strips 23 and 24 has a plurality of serpentine locking channels 26 recessed from its first surface 30. A plurality of inlet openings 32 are registered with the apertures 22 in the stack of paper 21 with each such opening 32 extending between the second surface 31 of the strip 23 or 24 and an end of one of the locking channels 26.

Each of the locking channels 26 is defined by a planar bottom wall 33 that is generally parallel with and recessed from the first surface 30, opposed side walls 37 that are recessed from and intersect the first surface 30, and end walls 34 and 35 that extend between the side walls 37. The side walls 37 are wall means of the strip (support member) that define the serpentine shape of the channel 26. Each side wall 37 forms a plurality of teeth 38 with the edges or tips 39 of the teeth of each side wall 37 projecting toward the other side wall 37. The serpentine opening is in a plane parallel to the first surface 30 with the teeth 38 disposed in an alternating pattern so that they will engage and deform the filament at alternating areas of opposite sides of the filament when the filament is inserted into the channel. The teeth 38 are each formed by two planar wall portions 37 that are generally normal to the first surface 30 and the bottom wall 33 with such planar wall portions 37 disposed at an included angle of about 90 degrees. The teeth 38 of the opposed walls 37 are spaced so that the tips 39 of the teeth 38 on each opposed wall 37 project toward one of the spaces between the teeth 38 on the other opposed wall 37. The distance between the tips 39 of the teeth 38 on one wall and the tips of the teeth on the other wall (measured perpendicular to and between an imaginary line drawn between the tips 39 of the teeth 38 defining one opposed wall 37 and a second imaginary line drawn between the tips 39 of the teeth 38 defining the other opposed wall 37) is less than the diameter of the filament. The width between all portions of the opposed walls 37 is preferably at least as great as the diameter of the filament to afford ease of insertion thereof into the channel; a smaller width could also be tolerated. The depth of each channel 26, measured between the first surface 30 and the bottom wall 33 is greater than the cross section of the filament 25 such that the filament can lie entirely within the channel 26 to provide a binding having no protuberances beyond the first surface 30 of the strips 23 and 24.

The attaching means of the binding device 20 also includes means for guiding one of the filaments 25 into one end of each locking channel 26 to direct tensional forces applied to that filament longitudinally along the length of filament in the channel to engage the deformations with the wall means. Such means for guiding prevents forces in the filament from lifting the filament from the channel 26. Such means include walls that define the inlet opening 32 between the second surface 31 of the appropriate strip 23 or 24 and one end of the locking channel 26, which walls provide a path for and guide the filament 25 through the strip in a direction generally normal to the first surface 30 as the filament bends at about a right angle to enter the locking channel 26; and a guiding ledge 44 projecting from one of the channel walls adjacent the opening 32, which ledge also guides the filament 25 as it bends to enter the locking channel 26 and directs the filament 25 and the forces thereon along the channel 26.

The guiding ledge 44 has a flat contact surface generally parallel to and opposite the first surface 30, has the shape of one of the teeth 38 when viewed from the first surface 30 and is formed by a cylindrical undercut 46 of the bottom wall 33 and the opposed side walls 37. The undercut 46 forms a space in which a portion of the length of filament in the channel 26 will lie, a side surface of which portion engages the contact surface of the ledge 44 such that the ledge 44 retains the filament 25 as it bends to enter the channel 26 and directs forces thereon down the channel.

Each locking channel 26 also has a terminating ledge 47 at its end opposite the opening 32 adapted to engage an end of the length of filament in the channel to prevent the end from being snagged and pulled from the channel 26 during handling of a stack bound by the device 20. The ledge 47 has a flat surface generally parallel to and opposite the first surface 30 and is formed by a cylindrical undercut 48 of the bottom wall 33 and the opposed side walls 37.

Figure 4:
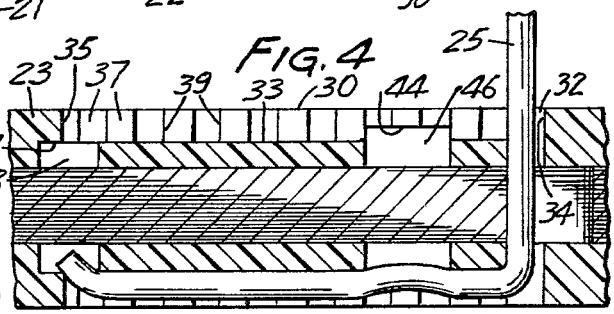
Figure 6:
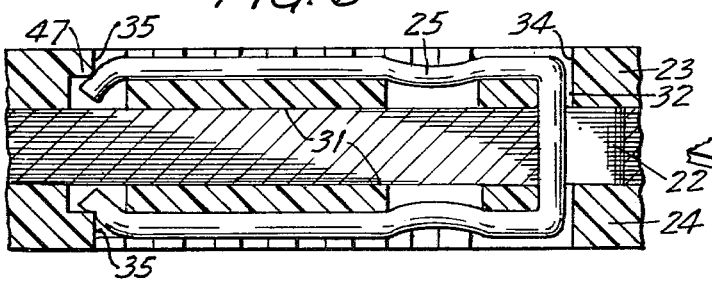

To bind the stack of paper sheets 21 with the device 20 one first inserts a length of one end of each filament 25 in a different one of the locking channels 26 in the strip 24 so that the filaments 25 project through the inlet openings 32 and away from the second surface 31 of the strip 24. The second surfaces 31 of the strips 23 and 24 are then positioned against the opposite side surfaces of the stack of paper 21 with the openings 32 registered with the apertures 22 and the projecting portions of the filaments 25 threaded through the apertures 22 in the paper 21 and the registered openings 32 in the strip 23 as shown in FIG. 4. The strips 23 and 24 are then pressed against the sheets 21 by the jaws 51 of two plier-like devices (FIG. 5) and the filaments 25 are sequentially and manually pulled taut via a clamp 52 while a rounded end of a presser tool 53 having a width slightly greater than the point to point dimension between the tips 39 of the teeth 38 is moved along the filament 25 from the opening 32 toward the opposite end of the locking channel 26 to press the filament 25 into the locking channel 26. As the filament 25 is pressed into the locking channel 26, a portion thereof adjacent the opening 32 moves under the contact surface of the guiding ledge 44. As the filament is pressed into the remainder of the serpentine channel, the teeth 38 engage and deform the filament 25 at alternating areas on opposite sides of the filament. It is believed that a combination of parameters including the distance between the tips 39 of the teeth 38 on the opposed walls 37 (previously defined), the flexibility and resiliency of the filament, the tension on the filament during installation and the distance between the teeth 38 along each wall 37 contribute toward causing the deformation of the filament. The centerline of the filament of the preferred embodiment also tends to form a slight serpentine pattern when the filament is inserted into the channel. As previously described, the presser tool 53 is slightly greater than the point to point dimension between the tips 39 of the teeth 38 such that the tips 39 of the teeth during installation may be permanently pressed down slightly. As the presser tool 53 nears the end of the filament 25, the filament is released from the clamp 52, may be cut to the proper length if necessary and its end is pressed under the terminating ledge 47 (FIG. 6).

It is believed that after installation the resiliency of the filament helps hold the deformations of the filament 25 in engagement with the teeth 38. Longitudinal tension on the filament due to usage of the binding after installation also more firmly engages the deformations with the teeth 38.

The following nonlimiting example of materials and dimensions for the device 20 will further facilitate understanding thereof. The filaments 25 are solid nylon monofilaments having a uniform diameter of 0.032 inch (0.81 mm) throughout their lengths such that the filaments are relatively rigid, but flexible and bendably resilient, have good tensile strength, and permanently deform during insertion. The strips 23 and 24 are made of Delrin ® and are approximately 0.25 inch (6.35 mm) wide, 0.10 inch (2.54 mm) thick and have a length adapted to extend along the edge of eleven inch (280 mm) paper 21. The locking channels 26 are 0.9 inch (22.86 mm) long, are spaced on 1.0 inch (25.4 mm) centers lengthwise and are centered with respect to the width of the strips. Corresponding portions of the teeth 38 of the walls 37 are parallel to each other and the width of the locking channels 26 measured normally between the wall portions 37 is approximately 0.046 inch (1.17 mm). The point to point distance between the tips 39 of the teeth 38 on one wall and the tips 39 of the teeth 38 on the other wall (previously defined) is 0.020 inch (0.51 mm). The depth of the recessed locking channels is 0.046 inch (1.17 mm). The opening 32 is 0.046 inch (1.17 mm) in diameter and is centered with respect to the width of the strip 23 or 24. The radius of curvature where the opening 32 and the bottom wall 33 meet is approximately 0.010 inch (0.25 mm). The cylindrical undercut 46 is 0.10 inch (2.54 mm) in diameter, is centered with respect to the width of the strip and extends into the strip from the second surface 31 to provide the guiding ledge 44 which is spaced approximately 0.025 inch (0.64 mm) from the first surface 30. The center to center spacing of the opening 32 and the cylindrical undercut 46 is approximately 0.150 inch (3.81 mm).

Figure 7:
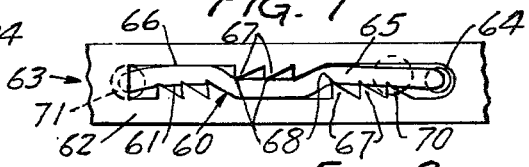
FIG. 7 is a fragmentary plan view showing an alternate configuration for the locking channel of a binding device according to the present invention.

FIG. 7 illustrates an alternate configuration of a serpentine locking channel, generally designated 60, which may be used in a binding device according to the present invention. Like the locking channel 26, the locking channel 60 has a bottom wall 61 parallel to and recessed from a first surface 62 of the strip 63, an inlet opening 64 to the channel 60 for a filament 65, opposed side walls 66 between the bottom wall 61 and the surface 62 each of which form a plurality of teeth 67 with the tips 68 of the teeth projecting toward the opposite side wall 66 to form a serpentine path therebetween in a plane parallel to the first surface 62 of the strip 63. In the locking channel 60, however, the channel walls form three alternate groups of teeth with three teeth in each group. The teeth 67 are each formed by two planar wall portions that intersect at about sixty degree angles to form the tips 68 of the teeth 67 with one wall of each tooth being perpendicular to the general longitudinal direction of the channel and the other wall of each tooth pointing generally away from the inlet opening 64 associated with the channel 60. The distance between the tips 68 of the groups of teeth on each wall is less than the diameter of the filament. Tension on the filament again causes the deformations to more tightly engage the teeth. A guiding ledge similar to the ledge 44 is formed by an undercut 70 and a terminating ledge similar to the ledge 47 is formed by an undercut 71.

Figure 8:
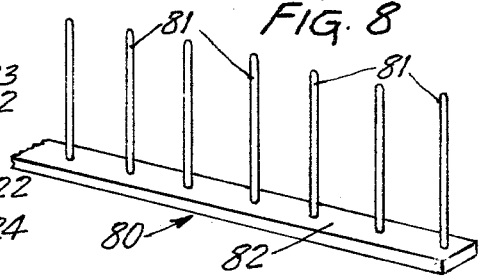
FIG. 8 is a fragmentary perspective view showing an alternate configuration for one of a pair of strips and a plurality of filaments for the binding device of FIG. 1.

FIG. 8 illustrates an alternate configuration of a strip and filament assembly 80 which could be substituted for one of the strips 23 or 24 and the filaments 25 of the binding device 20. In the assembly 80 the filaments are an integral part of one of the binding strips as by casting them together, cementing or knotting the filament portions 81 to the strip portion 82.

Figure 9:
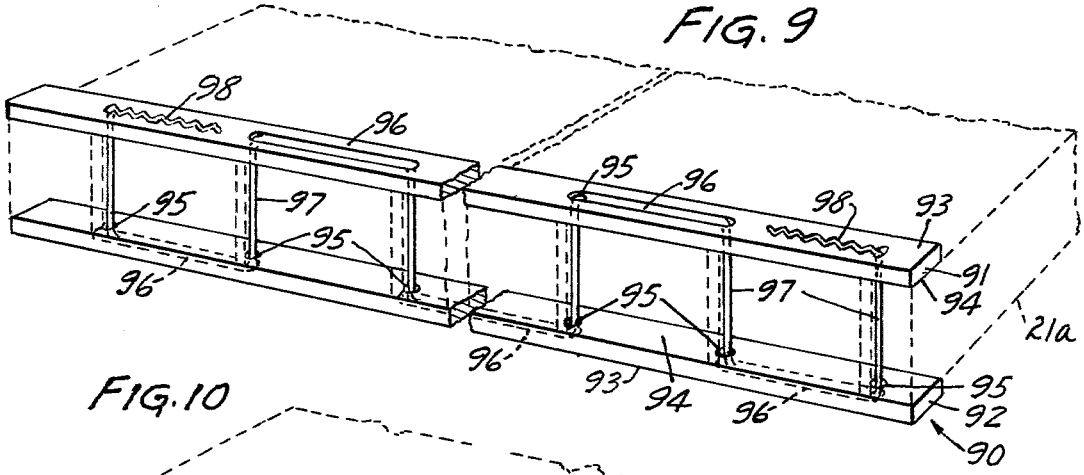
FIG. 9 is a fragmentary perspective view of a second embodiment of a binding device according to the present invention on a stack of paper sheets shown in dotted outline.

FIG. 9 illustrates a second embodiment of a binding device according to the present invention, generally designated by the number 90, which is also adapted for binding together a stack of paper sheets 21*a* (shown in dotted outline) having spaced apertures along one edge portion. The device 90 comprises first and second strips 91 and 92 each having a second surface 94 adapted to contact the stack of paper 21*a* with the strips 91 and 92 on opposite side surfaces thereof. Each strip has a first surface 93 opposite the second surface 94, and a plurality of openings 95 between the first and second surfaces 93 and 94 which are spaced to be in registration with the plurality of apertures in the paper sheets 21*a*. Each strip 91 and 92 has a plurality of recessed grooves 96 that communicate with its first surface 95, extend between every other two openings 95, and have sufficient width and depth to freely receive a filament 97 identical to the filament 25 below the surface 93 of the strip. The recessed grooves 96 are spaced so that a single filament 97 can be threaded through a first pair of registered openings 95 at one end of the strips, along one of the grooves 96 recessed in the first surface 93 of the second strip 92, through a second pair of registered openings 95, along one of the grooves 96 recessed in the first surface 93 of the first strip 91, through a third pair of registered openings 95, and so forth until the filament 97 passes through the pair of registered openings 95 adjacent the opposite end of the strips. The first strip 91 is formed with two locking channels 98, identical to the locking channels 26 of the device 20, which receive and attach lengths adjacent the ends of the filament 97 to the strip 91. The locking channels 98 have associated guiding ledges and terminating ledges similar to the ledges 44 and 46 that are associated with the locking channels 26. Alternatively, the binding device 90 could utilize only the binding strip 91 and the filament 97.

Figure 10:
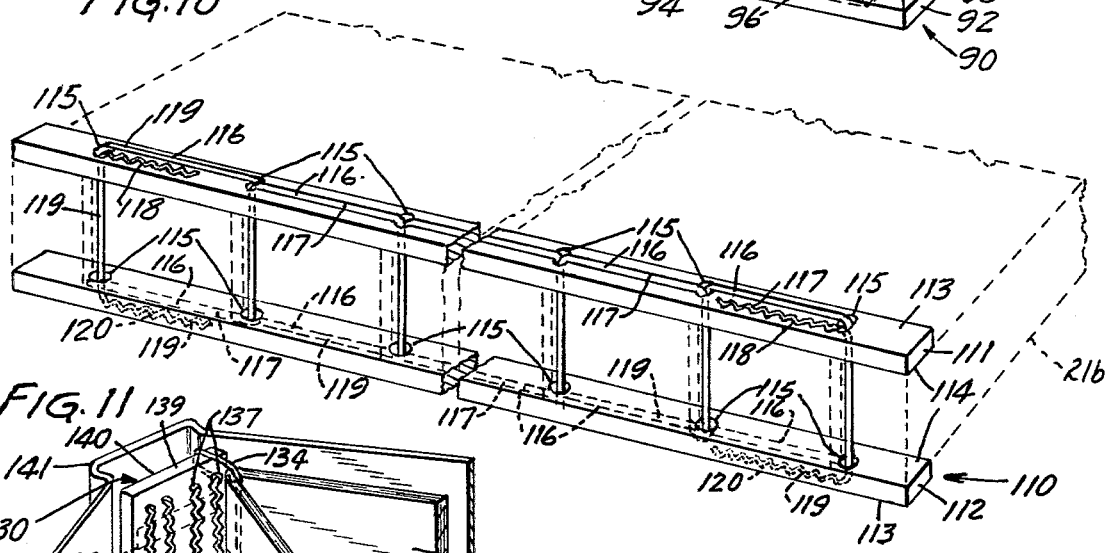
FIG. 10 is a fragmentary perspective view of a third embodiment of a binding device according to the present invention on a stack of paper sheets shown in dotted outline.

FIG. 10 illustrates a third embodiment of a binding device according to the present invention, generally designated by the number 110, that is also adapted for binding together a stack of paper sheets 21*b* (shown in dotted outline) having spaced apertures along one edge portion. The device 110 is similar to the device 90 in that it comprises first and second strips 111 and 112 each having a second surface 114 adapted to contact the stack of paper 21*b* with the strips 111 and 112 on opposite side surfaces thereof, a first surface 113 opposite the second surface 114, and a plurality of openings 115 between the first and second surfaces 113 and 114 which are spaced to be in registration with the plurality of apertures in the paper sheets 21*b* when the strips are positioned adjacent the paper 21*b*. Each strip 111 and 112 has a plurality of recessed grooves 116 that communicate with its first surface 113 and have a sufficient width and depth to freely receive a filament identical to the filament 25 below the surface 113 of the strip; however, in the device 110 the recessed grooves 116 extend between each pair of openings 115 in the strips 111 and 112. A first filament 117 is threaded through the registered openings 115 and alternate recessed grooves 116 with the lengths of the filament 117 adjacent its ends being received and attached in locking channels 118 in strip 111, identical to the locking channels 26 in the device 20. A second filament 119 is threaded through the registered openings 115 and the previously unoccupied alternate recessed grooves 116 with the lengths of the filament 119 adjacent its ends being received and attached in locking channels 120 in strip 112, also identical to the locking channels 26. Each of the locking channels 118 and 120 have associated guiding ledges and terminating ledges similar to the ledges 44 and 46.

Figure 11:
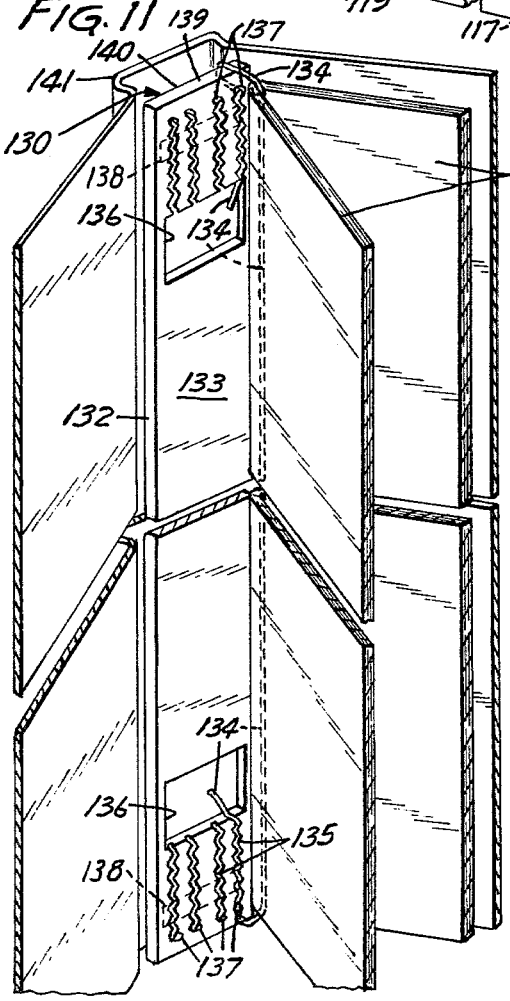
FIG. 11 is a fragmentary perspective view of a fourth embodiment of a device according to the present invention particularly adapted to bind stacks of folded paper sheets.

FIG. 11 illustrates a fourth embodiment of a binding device according to the present invention, generally designated by the numeral 130, which is adapted for releasably binding one or more signatures comprising stacks of paper sheets 131 folded upon themselves (such as magazines). The binding device 130 includes a rectangular strip 132 having a first surface 133 adapted to extend along the outer surfaces of the folds in stacks of sheets 131; and a plurality of filaments 134, each identical to the filament 25 and adapted to pass along the inner surface of the fold in one sheet in one of the stacks of sheets 131 and have lengths adjacent its ends attached to opposite ends of the binding strip 132 by means including serpentine locking channels 135 recessed from the first surface 133 of the strip 132 adjacent each of its ends. The locking channels 135 are identical to the channels 26 of the device 20 except that they do not have a terminating ledge, but rather open into a large recessed area 136 where the terminal end portions of the filament can lay. Besides openings 137 corresponding to the openings 32 of the device 20 and guiding ledges provided by undercuts 138, the means for guiding the filament into one end of the channel includes the end surfaces 139 and a second surface 140 of the strip 132 around which the end portions of the filament are guided.

The strip 132 is shown adjacent a decorative and/or protective cover 141 which may be attached to the strip 132 by releasable pressure sensitive adhesive.

Figure 12:
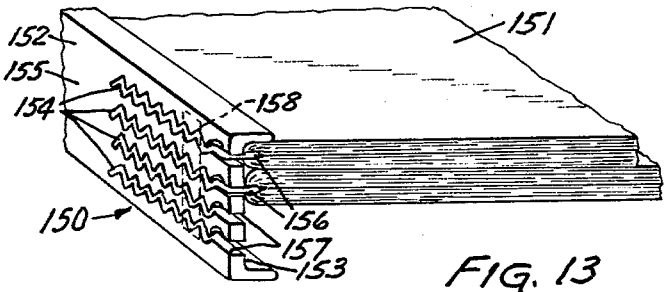
FIG. 12 is a fragmentary perspective view of a fifth embodiment of a binding device according to the present invention also adapted to bind stacks of folded paper sheets.

FIG. 12 illustrates a fragment of a fifth embodiment of a device according to the present invention, generally designated 150, which like the device 130 is adapted for binding one or more signatures comprising stacks of folded paper sheets 151. The device 150 includes a generally U-shaped strip 152 having an inner second surface 153 adapted to engage the outer surfaces of the folds of the stacks of sheets 151. The strip has a plurality of locking channels 154 identical to the channels 26 recessed adjacent one end of the strip 152 in a first surface 155 which is opposite to the second surface 153 to facilitate attaching the device 150. The device 150 also includes a plurality of filaments 156 each of which may be passed along the inner surface of the fold in one of the sheets of one of the folded stacks of sheets 151, through a slot 157 in the end of the strip 152 and have a length at its end inserted into one of the locking channels 154 in the strip 152. The means for guiding each filament into one end of each channel includes an inlet opening defined by the walls of the slot 157 which communicate with the end surface and second surface 153 of the strip 152, and a guiding ledge formed by an undercut 158. The end of the strip 152 opposite that shown may be similarly formed with locking channels to engage lengths of the filaments 156 adjacent their opposite ends or the opposite ends of the filament 156 may be permanently attached thereto.

Figure 13:
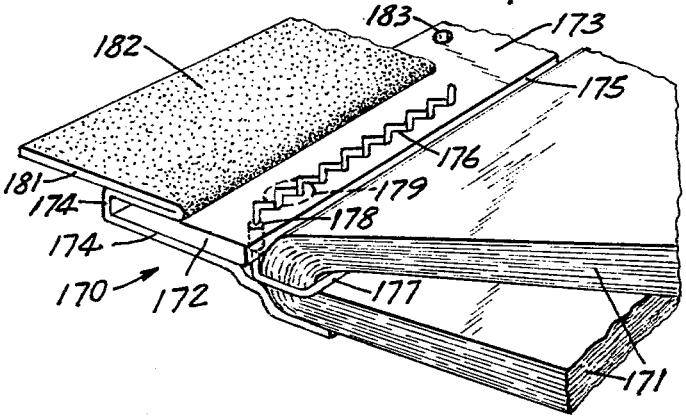
FIG. 13 is a fragmentary perspective view of a sixth embodiment of a binding device according to the present invention adapted to bind a single stack of folded paper sheets.

FIG. 13 illustrates a fragment of a sixth embodiment of a device according to the present invention, generally designated 170, which is adapted for binding a single stack of folded paper sheets 171, such as a magazine. The device 170 includes a rectangular binding strip 172 having opposite first and second surfaces 173 and 174 between which extends a third surface 175 that is adapted to be positioned adjacent the outer surface of the fold of the stack of sheets 171. A locking channel 176 identical to the channel 26 is recessed from the first surface 173 adjacent one end of the strip 172 and the device also includes a filament 177 which may be passed along the inner surface of the fold in one of the sheets 171 through an inlet opening (hole) 178 that communicates the second surface 174 with the locking channel 176 and have a length adjacent its end inserted into the locking channel 176. The device 170 comprises means for guiding the filament into one end of the channel including the walls of the inlet opening 178 and a guiding ledge formed by an undercut 179. The end of the strip 172 opposite that shown may be similarly formed with a locking channel to engage a length of the opposite end of the filament 177 or the opposite end of the filament may be permanently attached thereto. Device 170 has a layer of material 181, coated with a pressure sensitive adhesive 182, that can be used to cover the locking channel 176 and the junction between the magazine 171 and the strip 172.

Device 170 has holes 183 in strip 172 by which the device 170 and attached magazine 171 may be held by a ring binder or other similar device.

What is claimed is:

1. A binding device for binding a stack of sheets, said device comprising:

at least one flexible, radially deformable filament that is generally nonextensible in a longitudinal direction under normal binding forces and does not have a significant cross-sectional area reduction under normal binding forces, said filament being adapted to engage a said stack of sheets;

at least one support member adapted to be positioned adjacent at least a portion of a said stack of sheets, said support member having a serpentine locking channel defined by:

opposed walls recessed from and intersecting a first surface of said support member, each of said opposed walls being shaped to provide a plurality of teeth having tips projecting toward the other of said opposed walls and being spaced to receive and radially deform a length of said filament inserted therebetween;

walls defining an inlet opening through said support member between one end of said locking channel and a second surface of said strip opposite said first surface, said inlet opening walls being disposed to guide said filament through said strip in a direction generally normal to said first surface and to afford bending of said filament at about a right angle at said inlet opening and positioning of the length of said filament in said channel; and a guiding ledge projecting from one of said opposed walls and positioned adjacent said inlet opening, said guiding ledge having a contact surface generally parallel to and opposite said first surface, said guiding ledge positioned to engage a part of the side surface of said length of filament in said channel to retain a bend in said length of filament at said inlet opening.

2. A binding device according to claim 1 adapted for use with a stack of sheets having spaced apertures along one edge portion between opposite side surfaces of the stack, wherein:

said binding device comprises two support members adapted to extend along the opposite side surfaces of a said stack adjacent its apertured edge; and a plurality of filaments, each adapted to pass between said support members through a different one of the apertures in a said stack of sheets; and at least one of said members has a plurality of said locking channels spaced along its length with their corresponding inlet openings adapted to be in registration with the apertures in a said stack of sheets.

3. A binding device according to claim 2, wherein both of said members have a plurality of said locking channels adapted to be positioned with their corresponding inlet openings in registration with the apertures in a said stack of sheets.

4. A binding device according to claim 2, wherein said filaments are an integral part of one of said members.

5. A binding device according to claim 1 adapted for use with a stack ofsheets having spaced apertures along one edge portion between opposite side surfaces of the stack, wherein:

said binding device comprises two support members adapted to extend along the opposite side surfaces of a said stack adjacent its apertured edge, said members having openings between their first and second surfaces adapted to be in registration with the apertures in a said stack of sheets, and said filament is adapted to be threaded through the apertures in a said stack of sheets and the registered openings in said members to bind a said stack of sheets between said strips.

6. A binding device according to claim 1 adapted for use with a stack of sheets folded upon itself, wherein:

said member is adapted to extend along the outer surface of a stack of sheets adjacent the fold;

said filament is adapted to pass along an inner surface of one sheet of the stack adjacent the fold; and said means for attaching attaches said filament between the ends of said member to bind a said folded stack of sheets to said device between said member and said filament.

7. A binding device according to claim 1, wherein said opposed walls each have intersecting planar portions defining the tips of said teeth and being disposed at an angle of about 90 degrees adjacent said tips, and the teeth of each of said opposed walls are spaced so that the tips of the teeth on each of said opposed walls project toward one of the spaces between the teeth on the other of said opposed walls.

8. A binding device according to claim 1, wherein the width of said locking channel between all portions of said opposed walls is at least as great as the cross section of said filament, so that said filament may be easily inserted into said locking channel.

9. A binding device according to claim 1, wherein said filament is a polymeric monofilament having a solid circular cross section of a given uniform diameter throughout its length.

10. A binding device according to claim 1, wherein said filament has a cross-sectional area reduction of less than 10 percent under normal binding tension.

11. A binding device according to claim 1, wherein said filament is a nonelastomeric filament.

12. A binding device according to claim 1, wherein said filament is resilient when bent.

13. A device for binding together a stack of sheets having spaced apertures through one edge portion between opposite side surfaces of the stack, said device comprising:

a plurality of elongated, flexible, resilient, radially deformable, polymeric, monofilaments having a uniform diameter, being generally nonextensible in a longitudinal direction under normal binding forces and not having a significant cross-sectional area reduction under normal binding forces, said monofilaments each being adapted to pass through a different one of the apertures in a said stack of sheets;

two long narrow support members, each member having opposite first and second surfaces;

having a plurality of openings between said first and second surfaces adapted for registration with the spaced apertures in a said stack of sheets and for receiving said monofilaments;

being adapted to be positioned with its second surface adjacent a different side surface of a said stack with its openings registered with the apertures along a said edge; and having a plurality of generally longitudinal locking channels recessed from its first surface and adapted for releasably engaging end portions of said monofilaments, each locking channel having one end communicating with one of said openings;

being formed by walls recessed from the first surface of the member, said walls of each locking channel including opposed walls intersecting the first surface of the member, each of said opposed walls being shaped to provide a plurality of teeth having tips projecting toward the other of said opposed walls to form a serpentine channel therebetween, and being disposed to require radial deformation of the end portion of one of said filaments between the teeth of said opposed walls upon insertion thereof in said locking channel, the width of said locking channel between all portions of said opposed walls being at least as great as the diameter of said filament so that a length of said filament may be easily inserted into said locking channel between said opposed walls; and a guiding ledge adjacent the opening, said guiding ledge having a contact surface positioned generally parallel to and opposite said first surface such that the end portion of the filament, when inserted through said opening and into said channel, will lie at least partially against the contact surface of said guiding ledge so that the contact surface will direct tensional forces applied to said filament at the second surface of said strip longitudinally along the end portion of said filament in said channel between said opposed walls so that such forces will tend to engage the deformed areas of the end portion of said filament in said channel with said teeth.

14. A binding device according to claim 13, wherein said opposed walls each have intersecting planar portions defining the tips of said teeth and being disposed at an angle of about 90 degrees adjacent said tips, and the teeth of each of said opposed walls are spaced so that the tips of the teeth on each of said opposed walls project toward one of the spaces between the teeth on the other of said opposed walls.

15. A binding device according to claim 13, wherein said walls of each locking channel define a terminating ledge at the end of said channel opposite said opening, said terminating ledge having a contact surface opposite the first surface of the strip such that said filament end when inserted in said channel lies under and against said contact surface of said terminating ledge.

* * * * *